US005217033A

United States Patent [19]

Herman, Jr.

[11] Patent Number: 5,217,033

[45] Date of Patent: Jun. 8, 1993

[54] MOBILITY ASSISTING DEVICE

[76] Inventor: Harry H. Herman, Jr., 3003 Van Ness St., N.W., Ste. 204 S., Washington, D.C. 20008

[21] Appl. No.: 868,215

[22] Filed: Apr. 14, 1992

Related U.S. Application Data

[63] Continuation of Ser. No. 385,420, Jul. 27, 1989, Pat. No. 5,113,887.

[51] Int. Cl.[5] ..... A61H 3/02

[52] U.S. Cl. ..... 135/68; 135/69

[58] Field of Search ..... 135/67, 68, 69, 73; 248/188.3

[56] References Cited

U.S. PATENT DOCUMENTS

| | | | |
|---|---|---|---|
| 552,143 | 12/1895 | Rankin . | |
| 991,104 | 5/1911 | Trask | 135/73 |
| 1,183,008 | 5/1916 | Hipwood | 135/88 |
| 1,332,642 | 3/1920 | Tarbell | 135/73 |
| 1,459,333 | 6/1923 | Hipwood | 135/72 |
| 1,524,521 | 1/1925 | Lanzillotta | 135/73 |
| 1,704,683 | 3/1929 | Buz . | |
| 1,755,209 | 4/1930 | Danner . | |
| 2,005,507 | 6/1935 | Russell . | |
| 2,409,365 | 10/1946 | Lamb . | |
| 2,413,202 | 12/1946 | Vrooman . | |
| 2,453,742 | 11/1946 | Bowen | 135/77 |
| 2,474,722 | 6/1946 | Blume . | |
| 2,547,265 | 4/1951 | Hilgeman . | |
| 2,642,074 | 6/1953 | Pedley . | |
| 2,696,826 | 12/1954 | Davies | 135/73 |
| 2,707,477 | 5/1955 | Chapin . | |
| 2,792,052 | 5/1957 | Johannesen . | |
| 2,802,217 | 8/1957 | Wilhoyte . | |
| 2,811,978 | 11/1957 | Russell . | |
| 2,889,842 | 6/1959 | McCauley . | |
| 2,910,995 | 11/1959 | Jacuzzi | 135/77 |
| 3,058,120 | 10/1962 | Smith | 3/4 |
| 3,102,272 | 9/1963 | Emmert . | |
| 3,280,831 | 10/1966 | McCall-Parker | 135/86 |
| 3,289,685 | 12/1966 | Parker . | |
| 3,304,946 | 2/1967 | Cutes . | |
| 3,346,882 | 10/1967 | Wilhoyte . | |
| 3,524,456 | 8/1970 | Dixon . | |
| 3,550,602 | 12/1970 | Hesterman . | |
| 3,696,826 | 10/1972 | Gruzalski . | |
| 3,902,199 | 9/1975 | Emmert | 3/4 |
| 3,982,531 | 9/1976 | Shaffer . | |
| 3,999,565 | 12/1976 | Delacour . | |
| 4,062,372 | 12/1977 | Slusher . | |
| 4,314,576 | 2/1982 | McGee . | |
| 4,449,256 | 5/1984 | Prueitt . | |
| 4,497,390 | 2/1985 | Wilson | 248/188 |
| 4,721,125 | 1/1988 | Wang-Lee . | |
| 4,733,682 | 4/1988 | Ellena . | |
| 4,768,536 | 9/1988 | Hawkins . | |
| 4,793,370 | 12/1988 | Perez . | |
| 4,838,291 | 6/1989 | DiVito | 135/88 |

FOREIGN PATENT DOCUMENTS

| | | | |
|---|---|---|---|
| 720898 | 5/1942 | Fed. Rep. of Germany | 135/85 |
| 482885 | 2/1917 | France | 135/68 |
| 625044 | 4/1927 | France | 135/68 |

OTHER PUBLICATIONS

Commercially Available Crutch/Cane Base—Tan in color, marketed as Slip Nott.

Commercially Available Crutch/Cane Base—Gray Boot encased pivotable base, marketed unknown.

*Primary Examiner*—Henry E. Raduazo

*Attorney, Agent, or Firm*—Cushman, Darby & Cushman

[57] ABSTRACT

A mobility assisting device which includes a vertical support structure and a substantially planar base structure mounted to the vertical support structure so as to be articulatable relative thereto. Thus, the base remains parallel to the ground as the user rests upon the device and moves relative to the ground. Such a structure maximizes the stability of the device and minimizes the likelihood of slippage due to uneven, moist, icy or otherwise torturous terrain. The patient supporting structure is mounted to the vertical support structure so as to be pivotal relative thereto so as to avoid the translation of pressure points under the patient's arms and rubbing between the upper end of the crutch and the underarm. Further, the vertical support structure and the base structure are preferably spring mounted to one another so as to be urged into perpendicular relation.

6 Claims, 5 Drawing Sheets 34
44
42
44
38
40
36
16
40
16
36
10
58
60
56
54
56
58
64
64
12
62
52
62
72
70
70
16
16
74
14
30
26
22
20
28
18
24
24
20
28
18
22
32
26
28

34
84
86
82
90
92
x
y
H
ΔL

FIG. 6
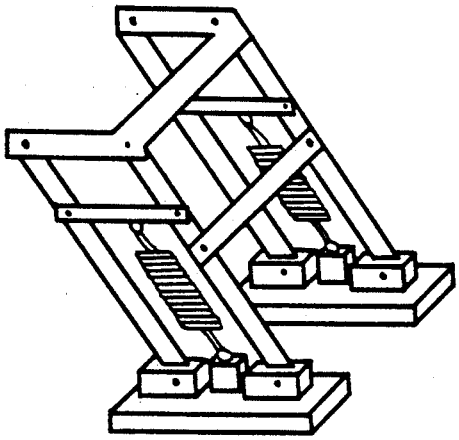
FIG. 7
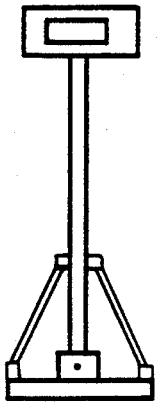
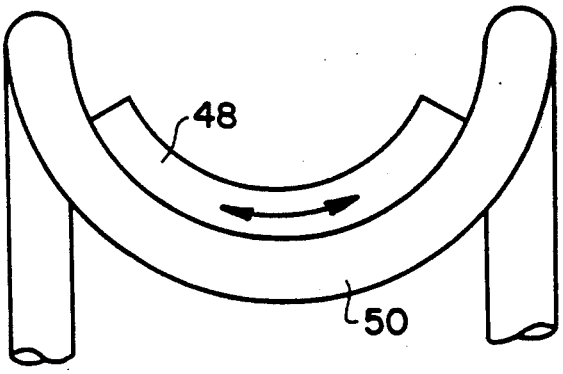
FIG. 8
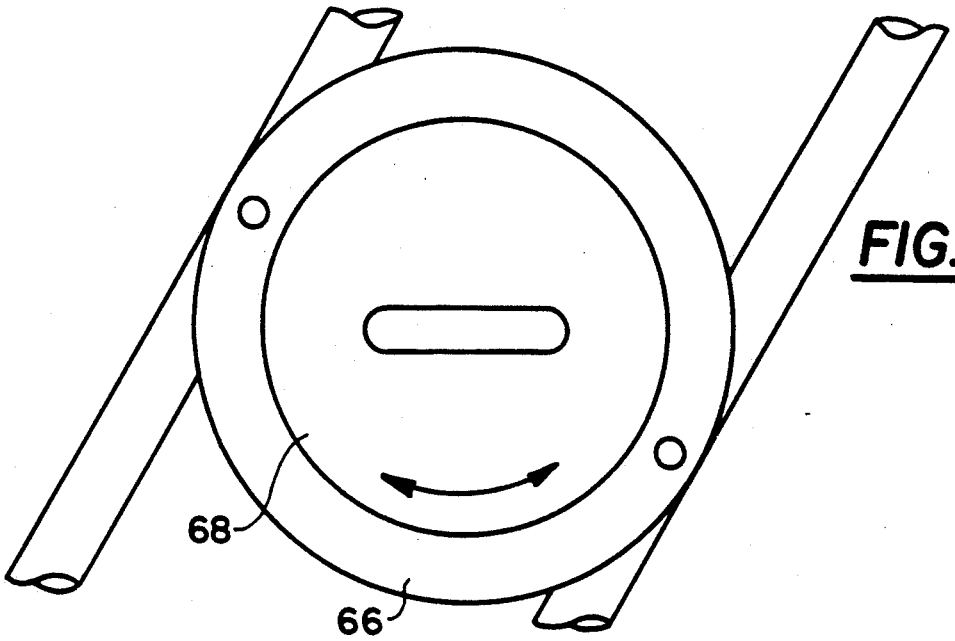
FIG. 9

MOBILITY ASSISTING DEVICE

This is a continuation of application Ser. No. 07/385,420, filed Jul. 27, 1989, and now U.S. Pat. No. 5,113,887.

BACKGROUND OF THE INVENTION

1. Field of the Invention

The present invention relates to devices for assisting the mobility of permanently or temporarily handicapped individuals and, more particularly, to an improved crutch-type device for assisting walking.

2. Description of the Related Art

Mobility is essential to functioning independently, particularly in today's highly mobile society. Thus, mobility is of constant concern to those individuals who are incapable of walking or who are limited in their ability to walk normally. It is well established that individuals who have difficulty walking would prefer to move about on their feet if at all possible rather than in a wheel chair. Ideally, then, devices should be provided to assist such handicapped or temporarily injured individuals to enable as near the ease and safety of walking as possible.

Crutches, walking sticks or canes, walkers and the like have been used for assisting people in walking for centuries. Typically, crutches have been in the form of an elongated member which is disposed under the arm of the user and extends to the ground so as to provide a support from under the user's arm to the walking surface. Walking sticks and walkers, on the other hand, are designed to be manually grasped by the user.

Crutches and other mobility assisting designs have been modified and improved over the years However, they continue to be rigid devices of predetermined configuration which the user for the most part must be trained to use.

Crutches require that the user balance himself upon the tip or bottom end of the rigid support which extends from under the arm to a small tip contacting the walking surface. However, the rubber-coated tip of the crutch has a cross-sectional area of only about 3 square inches. Thus if the tip comes into contact with a rock, loose gravel, the edge of a curb or other uneven surface, water, or ice, the individual using the crutches can slip and fall. This is also true for canes, walkers and walking sticks.

Conventional crutches are both uncomfortable and hazardous to the user. Indeed, crutches do not ergonomically fit people in a satisfactory manner. To prevent interference with the arms and body, conventional crutches must be used at an angle of 10° off the vertical with the base tip away from the users feet. Thus, conventional crutches cannot be correctly used in a vertical plane parallel to the user's body and they must be used so that the longitudinal axis thereof is not at a right angle to the walking surface. The angle at which the tip of the crutch contacts the ground not only from forward to rear, but also laterally, does not lend itself to proper traction. This lateral angle causes the fixed upper end of the crutch to place force against the upper ribs under the arms which can cause discomfort and injury. The forward and rear motion of the crutch and the resulting underarm motion causes abrasion by the upper end movement of a pressure point from a forward point to a rearward point under the arm as the crutches pivot relative to the ground from their forward to their rearward position. Thus, a great deal of padding must be added to the upper end of the crutch or the user will be injured temporarily or permanently and may cease use of the crutches to alleviate the associated discomfort or injury.

Crutch mobility under normal use of crutches is dependent upon the legs of the user, or one leg at least, leaving the ground and swinging forward like a pendulum, to the forward point where it contacts the walking surface. The leg or foot in contact with the walking surface then acts as a fulcrum or pivot while the crutches move off the surface from the rear position to the forward position. Crutches therefore operate on the basis that the top of the crutch moves in the form of an arc with the apex in the vertical or up-right position. This means that the user of a crutch must be raised then lowered by the use of the underarm rest, or by holding themselves up with their arms. The effort required to move forward on a crutch is increased due to the need to have a force or momentum in the action sufficient to lift the user during each forward step of the crutch. This lifting force also places cyclic forces upward on the users underarm and shoulders. When the user drops in the forward position, their feet or foot impacts the ground this can cause injury and discomfort especially to those with additional functional limitations or are elderly or frail. Furthermore, it is often the case that the user must wear a heavy cast or brace on their leg or foot. This further adds to the weight that must be raised from and lowered back to the ground.

The hand grips on conventional crutches are in a fixed position, and because of the aforementioned raising and lowering, as well as the dynamic forces under the arms, the conventional crutch user is required to utilize strength in the hands and arms to raise themselves. It is not unusual for the user to develop tired, sore or injured arms and hands.

Accordingly, despite various structural modifications and improvements, crutches remain quite difficult to use, uncomfortable and even injurious and dangerous. Thus, just at the time of pain, suffering, high anxiety, and weakness, the handicapped individual may further injure himself by use of a conventional crutch and/or sacrifice mobility out of fear of further injury and discomfort.

Canes and walking sticks also require balancing on a small rubber tip; although there has been an improvement in the form of a cane which has a short four legged base, the problem remains that hazards on the walking surface could cause the cane or walking sticks which have a small surface in contact with the ground to slip resulting in the user falling. In addition, the users hand or arm grip is rigidly fixed to the cane or walking sticks which can cause discomfort and possible injury or reduce the ability toward its use.

Conventional walkers have four legs, however, in use most of the time only the front two or rear two legs are in contact with the walking surface as in the case with the crutches and canes. Users are limited in conventional walkers due to their poor surface contact, especially uneven surfaces, ice, gravel, rocks, water, etc. Also users of walkers must adapt their hands and arms to the fixed hand grip or hand holds.

As in the case with crutches, walkers, canes, and walking sticks remain hazardous and difficult for some who need help in mobility to use.

It is therefore desirable to provide devices including a crutch for assisting the mobility of injured or handicapped individuals which provide a stable base structure that is ergonomically correct, does not require much instruction to use and minimizes the likelihood of slippage on wet or icy surfaces or that an uneven or rough walking surface will inhibit the stability of the crutch structure and thereby the mobility of the individual.

It is desirable to provide a crutch-like structure that minimizes the discomfort and possible injury to the individual's hand, feet, arm or underarm during use.

SUMMARY OF THE INVENTION

The present invention has the primary object of providing devices for assisting the mobility of injured or otherwise handicapped individuals by providing a stable base structure which remains substantially parallel to and flat on the ground surface throughout motion of the individual relative to the ground.

A further objective of this invention is the novel means for maintaining the hand hold, handle, or underarm grip parallel to the ground, or rotatable, so that their is no abrasive or rubbing action, and is ergonomically suitable to the conditions of the user.

One embodiment of the present invention has the further object of providing a bearing surface for contact with the user's body that minimizes friction and abrasive action therebetween and the translation of pressure points. Thus, it is an object of the invention to provide a mobility assisting device which is ergonomically suited to the human body.

To achieve the foregoing objects, the mobility assisting device of the present invention provides a base which is articulated relative to the vertical support structure thereof so that the base remains in parallel relation to the ground as the user rests upon and/or holds the device and moves relative to the ground so that the stability of the device is maximized and the likelihood of slippage due to uneven, moist, icy or otherwise torturous terrain is minimized. Further, the invention provides a bearing surface which does not move relative to the portion of the user's anatomy which it contacts.

More particularly, the objects of the invention are achieved with a mobility assisting device which includes a vertical support structure and a substantially planar base structure mounted to the vertical support structure so as to be articulatable relative thereto. Further, a supporting structure for under the users arm is mounted to the vertical support structure so as to be pivotal relative thereto so as to avoid the translation of pressure points under the users arms and abrasions due to the rubbing action between the upper end of the conventional crutch and the underarm. The vertical support structure and the base structure may have springs or actuators mounted to one another so as to be urged into perpendicular or through its cycle so as to assist users movement with the crutches or walking sticks.

Other objects, features, and characteristics of the present invention, as well as the methods of operation and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIGS. 2, 3, and 4 are three separate schematic views of the crutch like device shown in FIG. 1 in their forward, middle and rear positions or they would be which in use;

FIG. 6, 6A and 6B illustrate a further configuration of the invention wherein the applications are applied to a walker type device;

FIG. 7 illustrates a further configuration of the invention wherein the applications are applied to a cane type device;

FIG. 8 is a perspective view of an alternate underarm rest provided in accordance with the present invention;

FIG. 9 is a perspective view of an alternate hand grip provided in accordance with the present invention.

DETAILED DESCRIPTION OF THE PRESENTLY PREFERRED EXEMPLARY EMBODIMENTS

Figure 1:
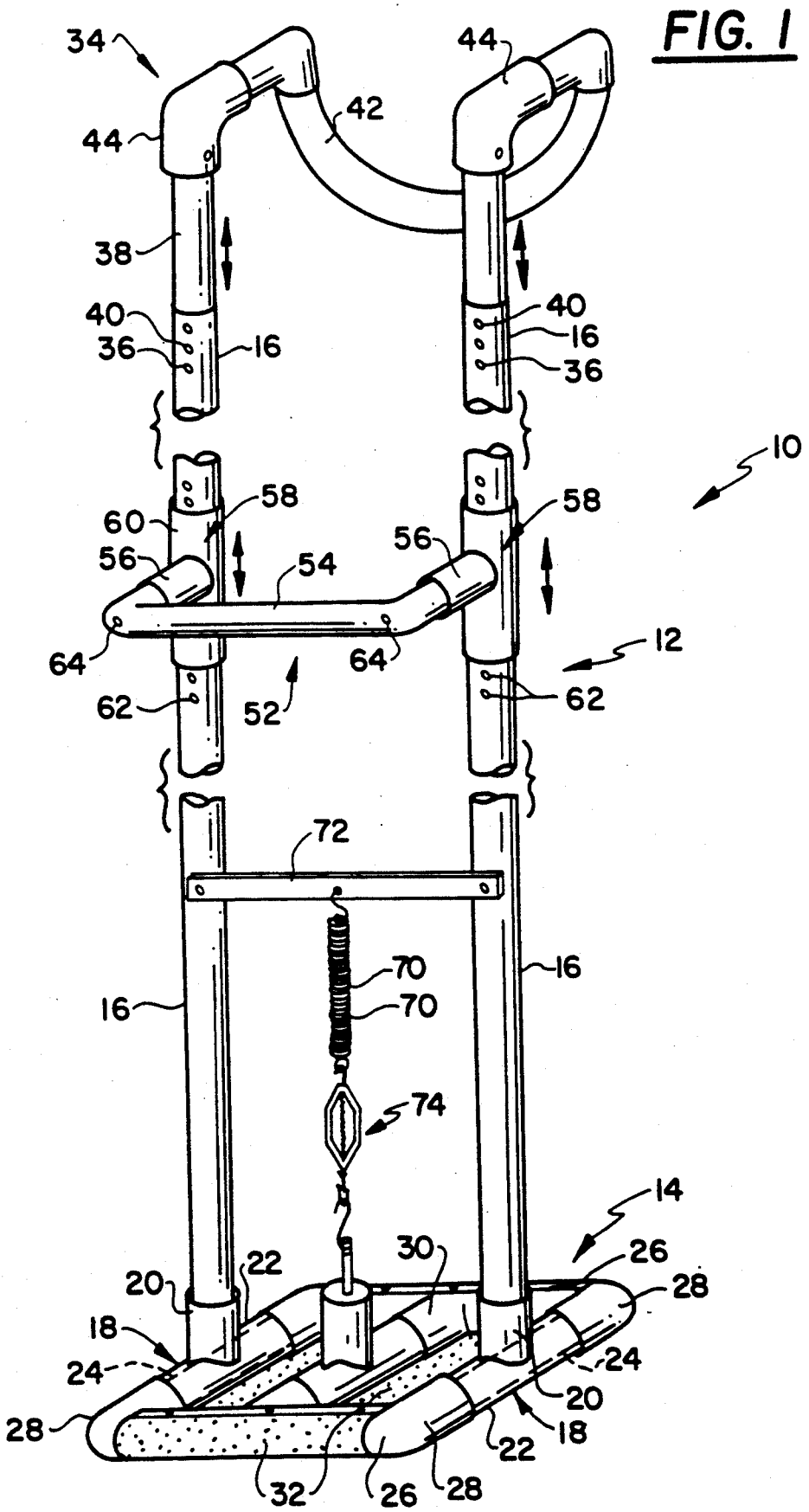
FIG. 1 is a perspective view of a first embodiment of a crutch-like device provided in accordance with the present invention.

A first embodiment of the invention is shown in FIG. 1. The crutch-like device 10 provided in accordance with the first embodiment of the present invention which may be referred to as the parallelogram configuration, has a substantially vertical main support structure 12 and a substantially horizontal base support structure 14. The vertical support structure 12 is defined by first and second vertical rod members 16. The rod members may be solid or hollow. However, to provide the pivotal interconnections of the present invention and to provide a lightweight crutch structure, the crutch-like device may be formed from, for example, polyvinyl chloride (PVC), wood, aluminum, graphite, etc. piping. Thus, the embodiment illustrated in FIG. 1 includes first and second vertical support rods 16 which may be solid or hollow and each of which is pivotally coupled to the base support structure 14. In the illustrated embodiment, this pivotal coupling is provided by a T-shaped tubular joint 18. The stem 20 of the T-shaped joint 18 is rigidly coupled to the vertical support rod 16 and the cross-bar 22 of the T-shaped joint 18 is rotatably coupled to the base structure 14 as described more fully below.

In the illustrated embodiment, the base support structure 14 is defined by a frame work of rod elements including first and second end rods 24 (shown in phantom lines), and first and second side rods 26. The vertical support rods 16 are pivotally coupled to the end rods 24 of the base 14. Thus, the cross-bars 22 of the T-joints 18 are pivotally coupled to the end rods 24. In the alternative, the crossbars are rigidly coupled to the end rods 24 and the end rods 24 are pivotally coupled to L-joints 28 which are in turn rigidly coupled to the side rods 26 or formed as a part thereof. A cross rod 30 may further be provided as described more fully below.

The coefficient of friction of the base support structure 14 can be desirably increased by mounting an elastomeric element 32 to the base support structure 14 so as to extend across a bottom face thereof. Preferably the friction enhancing elastomeric element 32 is removable and replaceable so that a variety of materials and/or traction increasing surface configurations can be provided, depending upon the environment in which it is used and the ground conditions, thereby maximizing the effectiveness of the same in maintaining stability of the crutch 10. In this regard, it is also noteworthy that because there are gaps between the tubular elements 26, 30 defining the base support 14 across which the elastomeric element 32 extends, the base support 14 is flexible in part so that it will tend to conform to a rough ground surface while still providing a stable support surface. In the alternative, the material of the base support structure 14 and/or the elastomeric element 32 may be selected to provide this conforming and safety characteristic as may be demanded for particular applications. In addition, the increased area of the base support 14 provides a greater frictional surface which reduces the likelihood of slippage at any point in its travel.

While in the illustrated embodiment the base support structure 14 is substantially square, it is to be understood that the base can be of any shape including circular, rectangular, triangular and the like. Further, the base support structure 14 can be either a solid piece or a frame-like structure as shown. It is also noteworthy that in use, it may not always be possible for the base to be normal to the plane of movement of the crutch. This is because of hills, rocks, uneven walking surface etc. Therefore, it is intended that the base be able to articulate a certain amount laterally so that it can engage the ground in a manner which maximizes contact therewithin even if it is not placed normal to the vertical portion of the crutch. It is also to be understood that the base 14 of the crutch 10 can be pivotally coupled to a single vertical support member or to first and second vertical support members that are disposed at an angle relative to one another while still realizing the advantages of the structure of the invention. Indeed, it is only critical that the base be at least pivotal relative to the vertical support structure 12 so that, as can be seen in the schematic illustrations of FIGS. 2*a–c*, 3*a–c*, and 4*a–c* the base 14 of the crutch structure 10 remains in contact with and parallel to the ground throughout the motion of the vertical support structure 12.

Figure 2C:
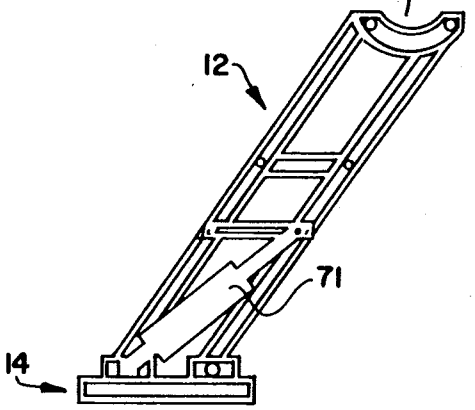
FIGS. 2*a*, 2*b*, and 2*c* is an embodiment in which the spring 70 in FIG. 1 is replaced by a powered actuator to provide a power assisted crutch.
Figure 2B:
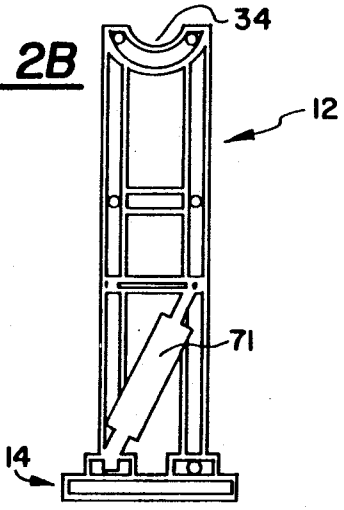
Figure 2A:
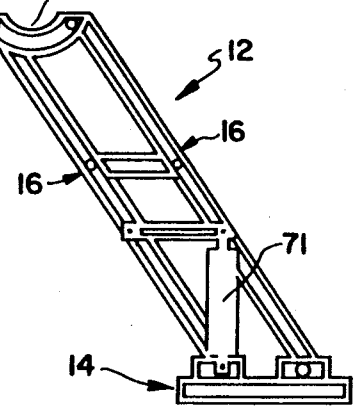
Figure 3C:
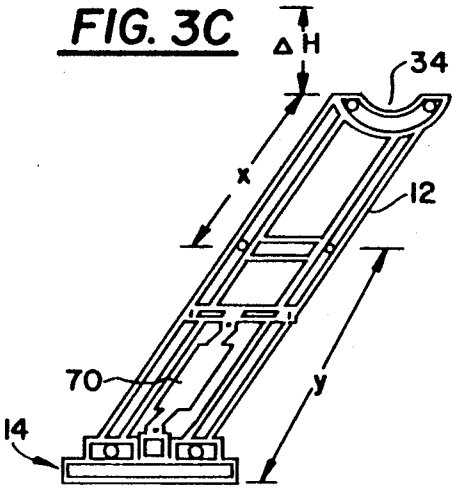
FIGS. 3*a*, 3*b*, and 3*c* is the embodiment shown in FIG. 1 in the three positions.
Figure 3B:
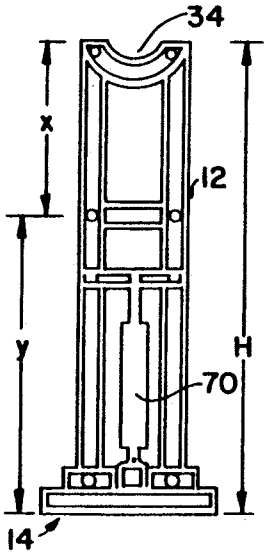
Figure 3A:
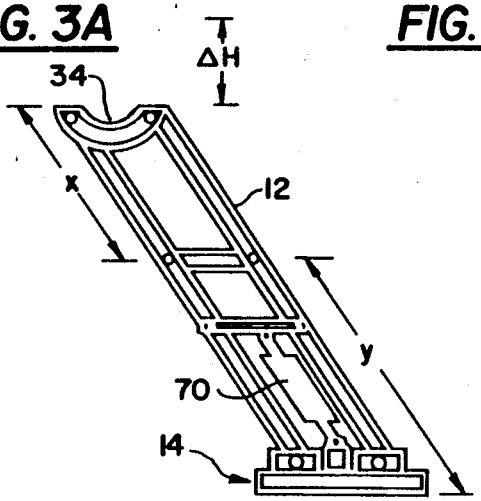

FIGS. 2*a*, 2*b*, and 2*c* show a pneumatic, hydraulic or other form of actuator such as a motor or magnetically driven means. Further, with this power assisted system it is desirable for some users to be able to control the action of the base and the crutch motion. This can be accomplished via a button or switch on the hand grip or on the base which functions when it is used. For example, if the crutch is in the forward position (FIG. 2*a*) and the user wishes to move forward, they could activate the switch and such actuators would assist the user in moving forward by causing the top of the crutch to move from the rear to the forward position.

Referring to FIG. 2, the embodiment is illustrated as a power assisted crutch. In this example, the actuator 71 in FIG. 2*a* is actuated a control switch which is mounted in the crutch, the handle 54 (FIG. 1) or on the crutch base 14. The switch on the base 14 (FIG. 2) is provided so that when the crutch is in the forward position (FIG. 2*a*), the switch is automatically actuated and the actuator extends moving the crutch members 12, as well as the entire crutch, to the center (FIG. 2*b*), and then to the rear position (FIG. 2*c*). At this position the switch can either automatically or manually deactivate the system.

The power assisted crutch will greatly reduce the effort required for obtaining mobility with a crutch. This is of special value to those who, because of their functional limitations, must now be confined to a wheelchair, or can only use crutches for a limited time because of weakness.

A spring element 70 (FIG. 3) is preferably mounted to extend between the base structure 14 and the vertical support elements 12, as shown in FIG. 1, so as to urge the support structure 12 and base 14 into a substantially perpendicular disposition. In the embodiment of FIG. 1, the spring 70 is coupled centrally to a cross rod element 30 of the base 14, and is coupled to an elongated support 72, for example, pivotally coupled to each of the support rods 16. The spring element 70 dampens the pivotal motion of the vertical support structure 12 relative to the base 4 and therefore adds stability to the crutch structure 10. More particularly, with reference to FIGS. 3*a*, 3*b* and 3*c*, the spring or tension device 70 facilitates use of the crutch as follows. When the crutch 10 is placed in the forward position, the spring 70 is under tension and the articulated base 14 lays flat on the walking surface. To walk with the crutch, the user swings their body forward. While doing this the spring 70 force assists the user in walking on the crutch 10 by reducing the effort or force needed to move forward. The result of the spring action changes as the cycle continues. As the user has the crutch 10 directly under him, the tension is at its lowest point. Then, as the user passes through this point and the crutch 10 moves rearwardly, the spring 70 is again placed under tension which causes the user to slow down. Provision is made as well for the tension on the spring 70 to be adjusted as a function of the users weight, and ease of use. Thus, the spring or other tension producing means is provided with a tension adjusting device such as a turn buckle 74.

Further, the spring like action is desirable but not essential for the crutch to operate. Indeed, the device will operate with or without the tension producing means and some users may find it easier to use without tension loading.

Figures 4A, 4B, 4C:
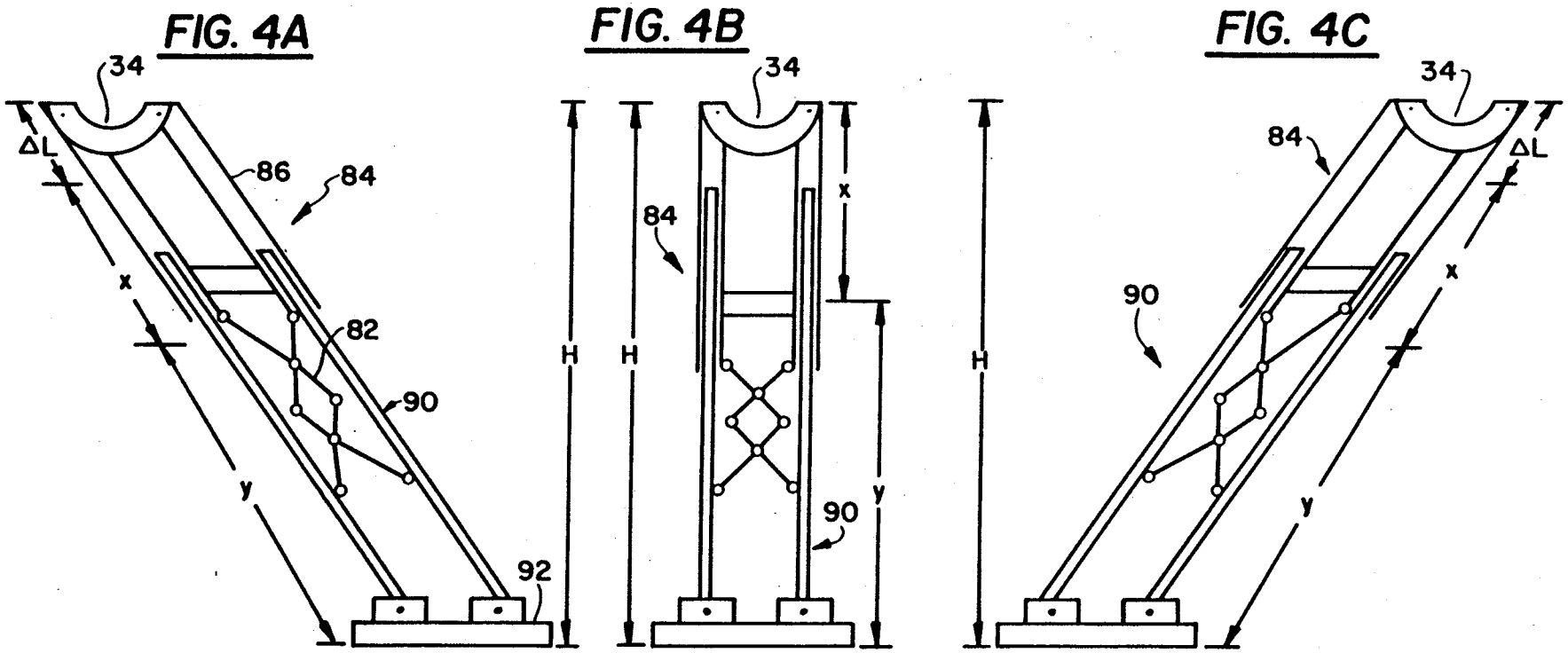
FIGS. 4*a*, 4*b*, and 4*c* is a further embodiment where in the upper portion 86 is raised and lowered via a mechanical or cam linkage 82 so that the under arm support is raised and lowered as the crutch moves from the forward to the rear position. In this configuration it can be seen by comparing it with FIG. 3, the distance between the top or underarm support and the ground remains constant as the crutch goes through its positions.
Figure 5:
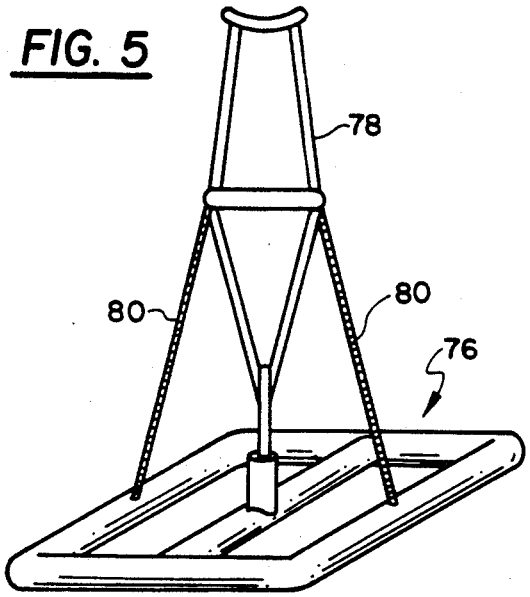
FIGS. 5, 5A and 5B illustrate an alternate configuration of the invention in conjunction with a conventional crutch. This articulated base can be either built as part of the crutch, or as an attachment to conventional crutches.
Figure 5A:
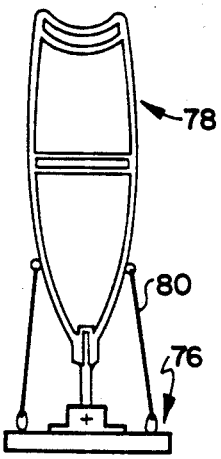
Figure 5B:
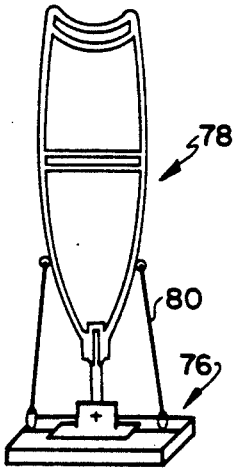
Figure 6A:
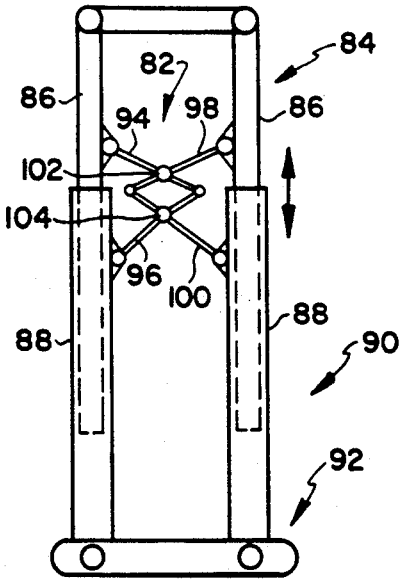
Figure 6B:
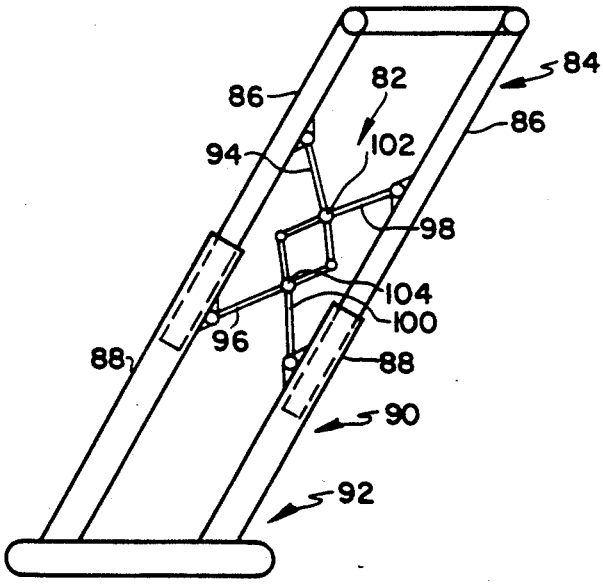

A further feature of the present invention is illustrated in particular in FIGS. 4*a*, 4*b*, and 4*c* and in FIGS. 6*a* and 6*b*. In this embodiment, a linkage system 82 is provided which maintains a constant height for the crutch-like device. Thus, as shown schematically in FIG. 6*a*, by way of example, an upper portion 84 of the crutch device including first and second rods 86 is telescopingly received in first and second vertical tubes 88 defining the lower portion 90 of the crutch device. The tubes 88 are pivotally mounted to a base 92 which is substantially similar to the base 14 illustrated in and described with reference to FIGS. 1 and 5. The illustrated linkage system 82 includes a first linkage rod 94 pivotally mounted at a first end thereof to one of the telescopingly received rods 86 and pivotally coupled at the other end thereof to a second linkage rod 96 which is in turned pivotally mounted to the tube 88 which receives the first rod 86. A third linkage rod 98 is pivotally mounted to the other of the telescopingly received rods 86 and pivotally is mounted and its other end to a fourth linkage rod 100 pivotally coupled to the other tube 88. The first and third linkage rods 94, 98 are pivotally coupled at 102 and the third and fourth rods 96, 100 are pivotally coupled at 104. As the upper portion 84 of the crutch device is moved, for example, to the right, the linkage system 82 causes the upper portion 84 of the crutch to move vertically upwardly out of the tubes 88 to the position shown, for example, in FIG. 6*b*. Thus, the overall length of crutch device between the base and the uppermost underarm support increases whereas the overall vertical height of the crutch device remains constant. (Compare FIG. 3 wherein the length of the device remains constant (x+y) and the overall height charges by H to FIG. 4 wherein the length of the device changes (x+y+L) but the overall height H remains constant.) Because the height of the device remains constant, the user of the crutch need not pass through an arc as is the case with typical crutches and thus the pressure on the underarm will be maintained constant. Furthermore, because the user does not need to "hop" or otherwise skip through the center point of the pivoting motion, the user can stand on a wheeled or sliding platform, or have a wheel or wheels attached to a cast, for example, and simply use the pull and push motion afforded by the frictional engagement of the crutch with the ground to impart mobility. While a particular linkage system is illustrated, it is to be understood, that other linkage system or a camming mechanism for example between the vertically upper portion of the crutch and the tubular members could be provided to maintain a constant height for the crutch like device. It is to be noted that a telescoping structure is not necessary as other means can be used such as slotted members, or other extension means.

The crutch-like mobility assisting device 10 of the invention also minimizes discomfort and/or injury to the underarm area in one of two ways. If the parallelogram configuration of FIG. 1 is utilized, the underarm end of the parallelogram structure is pivoted relative to the vertical support rods 16 so as to move forward and back. More particularly, the underarm support structure 34 is slidably mounted to the vertical support rods 16 and vertically adjustable relative thereto by aligning apertures (not shown) defined through vertically extending portions 38 of the underarm support 34 and corresponding apertures 40 defined through the vertical support rods 16 and inserting one or more pins 36 or other fastening means. Further, the cross bar member 42 of the underarm support 34 is pivotally mounted to L-shaped joints 44 which are rigidly coupled to the vertically upper end of the vertical portions 38 of the underarm support 34.

The cross bar member 42 (arm rest) is secured to the L-shaped joints 44 with, for example, a nut and bolt (not shown). Because the cross bar member 42 is pivotally mounted to the vertically extending portions 38, which are in turn slidably coupled to the vertical support rods 16 of the crutch device 10, the underarm support 34 is pivotal relative to the vertical support structure 12 and remains parallel to the underarm during motion of the crutch 10 as shown in the schematic representation of FIGS. 2, 3, and 4. Because the underarm support 34 does not move with respect to the underarm, the pressure against the underarm of the user remains constant and is uniformly distributed throughout the entire movement of the crutch 10. This eliminates the problems of injury caused by a constantly moving pressure point and abrasive rubbing action between the underarm support of conventional crutches and the underarm. The underarm engaging portion of the crutch of the invention as shown can be curved and/or padded to conform to the shape of the underarm to even further minimize the likelihood of injury or abrasion at its point of contact with the users anatomy.

As is shown in FIG. 1, in particular, the underarm support 34 is preferably offset relative to the vertical plane of the vertical support structure 12 so that in use the vertical support structure 12 is offset from the user's body. This offset dimension can be adjusted to fit the size of the user. Offsetting the vertical support 12 in this manner makes the crutch ergonomically correct and enables it to be used in a vertical plane minimizing the likelihood that the crutch structure 10 will contact the user's sides or legs during use.

As shown in FIG. 8, the second method of minimizing discomfort and injury of the sensitive underarm area is by providing an independently rotatable underarm support. In the illustrated embodiment, the support includes a circular or semicircular underarm engaging element 48 which is rotatably mounted within a circular or semi-circular mounting element 50. The mounting element 50 can be pivotally coupled to the vertical support structure 12 of the crutch 10 directly by means of pivot pins or indirectly by means of vertically extending tubular elements to which the mounting element is pivotally coupled and which are in turn slidably mounted to the vertical support structure 12. The underarm support of FIG. 8 provides an even distribution of load during the use of the crutch and eliminates the rolling motion of the crutch against the underarm.

As a further feature of the present invention the hand grip 52 is slidably mounted to the vertical support structure 12 and pivotal relative thereto. Thus, in the embodiment of FIG. 1, the hand grip 52 is slidably mounted to the first and second vertical support rods 16. In that embodiment, the hand grip 52 is defined by a crossbar member 54 which is pivotally coupled to the stems 56 of first and second T-shaped tubular joints 58. The crossbars 60 of the T-shaped joints 58 are in turn slidably mounted to the vertical support rods 16. The dimension between the cross bar member 54 and the vertical rods 16 can be regulated for the user's comfort. Thus, the hand grip structure 52 may be fixedly secured at one of a number of predetermined levels on the support rods 16 by inserting a bolt (not shown), for example, through an aperture (not shown) defined in the T-joint, through one of several aperture 62 defined through the vertical support rods 16 and an aperture 64 defined in the cross bar member 54. The locking bolt is secured in its inserted position with, for example, a nut screwthreaded to the end thereof which extends through the cross bar member 54. Such locking bolts also secure the crossbar member 54 to the T-shaped joints 58.

The structure of FIG. 1 provides a hand grip 52 that remains parallel to the walking surface. This provides a uniform force to the hand and wrist but the wrist must bend from the forward to the rear. While this is desirable for many users, there are, however, those who either cannot or prefer not to move or bend their wrist.

As an alternative, then, a circular or semi-circular element 66, or pivotally mounted handle can be attached to the vertical support structure 12 with a hand grip element 68 rotatably mounted therewithin, as shown in FIG. 9. In this manner the hand grip is freely rotatable relative to the crutch support structure so that it can be easily gripped in a comfortable manner by the user and at a desired angle relative to the vertical support structure 12 for facilitating use of the crutch. Indeed, with such a grip, the hand need not rotate at the wrist as the grip itself rotates as the crutch is moved.

As shown in FIG. 5, an alternate embodiment of the present invention is shown. In this embodiment, the base 76 is designed so that it can either be built onto, or attached to a conventional crutch 78 to give it greater stability and reduce the likelihood of slipping upon surface hazards. The spring stabilizers 80 are coupled in any suitable manner to the vertical crutch structure 78. The base 76 itself is substantially similar to the base support structure illustrated in FIG. 1.

As is apparent from the foregoing, the articulated vertical support structure and flat base provided in accordance with the present invention can be employed not only in crutch-like devices but could also be employed for each of the three or four legs of a walker-type device which is manually grasped and leaned upon to facilitate mobility (FIG. 6). Similarly, the articulated base and vertical support structure of the invention could be employed as a walking stick, cane or the like (FIG. 7).

As can be seen, if the upper telescoping portion of the crutch 38 (FIG. 1) is removed, the lower portion can be used as a cane or two crutches can be joined to form a walker as seen in FIG. 6. In the lowermost position, the underarm grip or an accessory grip can be used as a hand grip so that the device can serve as a cane.

In the alternative, the base 76 of FIG. 5 can be mounted to the tip of a conventional cane as shown in FIG. 7.

As a further example, brackets can be provided to attach the left and right crutches to form a walker-type structure. Another alternative is to provide a separate four-legged walker having articulated bases of the type shown in FIG. 5.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

I claim:

1. A mobility assisting device comprising:

a base support structure;

a vertical support structure pivotally coupled to said base support structure; and a cross bar element coupled to said vertical support structure whereby, in use, said base support structure pivots relative to said vertical support structure, said vertical support structure including a first support structure telescopically received in a second support structure, said first support structure including first and second vertical rods, and said second support structure including first and second tubular members for telescopingly receiving said rods, and means for coupling said rods and said tubular members so that the overall vertical height of the device is maintained constant throughout pivotal motion of said vertical support structure relative to said base support structure, said means for coupling comprising a linkage system, said linkage system including first and second linkage rods pivotally coupled to each other at a first end thereof and pivotally coupled at a second end, respectively, to a said rod and to a said tubular member, and third and fourth linkage rods pivotally coupled to each other at a first end thereof and pivotally coupled at a second end, respectively, to said other rod and to said other tubular member, said first and third linkage rods being pivotally coupled together and said third and fourth rods being pivotally coupled together.

2. A mobility assisting device as in claim 1, wherein said underarm support is defined in a vertical plane which is laterally offset with respect to a vertical plane of said vertical support structure.

3. A mobility assisting device comprising:

a base member;

a vertical support structure pivotally coupled to said base member;

an underarm support member coupled to said vertical support structure;

a hand grip element coupled to said vertical support structure; and means for maintaining a constant overall height of the device, said vertical support structure including a first support structure telescopically received in a second support structure, said first support structure including first and second vertical rods, and said second support structure including first and second tubular members for telescopingly receiving said rods, and means for coupling said rods and said tubular members so that the overall vertical height of said device is maintained constant throughout pivotal motion of said vertical support structure relative to said base member, said means for coupling comprising a linkage system, said linkage system including first and second linkage rods pivotally coupled to each other at a first end thereof and pivotally coupled at a second end, respectively, to a said rod and to a said tubular member, and third and fourth linkage rods pivotally coupled to each other at a first end thereof and pivotally coupled at a second end, respectively, to said other rod and to said other tubular member, said first and third linkage rods being pivotally coupled together and said third and fourth rods being pivotally coupled together.

4. A mobility assisting device as in claim 3, wherein said underarm support member is pivotally coupled to said vertical support structure.

5. A mobility assisting device as in claim 3, wherein said hand grip element is pivotally coupled to said vertical support structure.

6. A mobility assisting device as in claim 3, wherein said base member comprises means defining a substantially planer base support structure.

* * * * *